US010905180B1

(12) United States Patent
Minaev et al.

(10) Patent No.: US 10,905,180 B1
(45) Date of Patent: Feb. 2, 2021

(54) INJURY PROTECTION DEVICE

(71) Applicants: Evgeny Olegovich Minaev, Voronezh (RU); Igor Anatolievich Kuznetsov, Voronezh (RU)

(72) Inventors: Evgeny Olegovich Minaev, Voronezh (RU); Igor Anatolievich Kuznetsov, Voronezh (RU)

( * ) Notice: Subject to any disclaimer, the term of this patent is extended or adjusted under 35 U.S.C. 154(b) by 0 days.

(21) Appl. No.: 17/044,899

(22) PCT Filed: Mar. 28, 2019

(86) PCT No.: PCT/RU2019/000194
§ 371 (c)(1),
(2) Date: Oct. 2, 2020

(87) PCT Pub. No.: WO2019/194704
PCT Pub. Date: Oct. 10, 2019

(30) Foreign Application Priority Data

Apr. 3, 2018 (RU) ..... 2018111935

(51) Int. Cl.
*A41D 13/05* (2006.01)
*A41D 31/28* (2019.01)
*A41D 27/12* (2006.01)

(52) U.S. Cl.
CPC ..... *A41D 13/0512* (2013.01); *A41D 27/12* (2013.01); *A41D 31/28* (2019.02)

(58) Field of Classification Search
CPC ..... A41D 13/0512; A41D 27/12; A41D 31/28
See application file for complete search history.

(56) References Cited

U.S. PATENT DOCUMENTS 3,164,151 A * 1/1965 Vere ..... A61F 5/055 602/18
3,497,872 A * 3/1970 Mitchell ..... A63B 71/10 2/468
4,881,529 A * 11/1989 Santos ..... A41D 13/0512 2/468
5,483,698 A * 1/1996 Douglas, Jr. ..... A41D 13/0512 2/462
6,189,327 B1 2/2001 Strauss et al.
(Continued)

FOREIGN PATENT DOCUMENTS

CA 3005557 A1 * 5/2017 ..... A61F 13/128
CA 3016454 A1 * 9/2017 ..... A61F 13/128
(Continued)

*Primary Examiner* — Tajash D Patel
(74) *Attorney, Agent, or Firm* — Nadya Reingand; Yan Hankin

(57) ABSTRACT

The invention relates to personal injury protection means for protecting, for example, the neck, which can be used in sports such as football, hockey, basketball, handball, rugby, etc. The invention is directed toward increasing the level of protection against impact injuries and improving thermoregulation of the human body. This is achieved by virtue of a flexible structural element (1), and a guard (2) for protecting the back of the neck, these being made of a polymeric material capable of absorbing and dissipating impact energy, in the form of a strip in the form of a collar. The structural element consists of a centre portion (8) and two side portions (9).

1 Claim, 3 Drawing Sheets

(56) References Cited

U.S. PATENT DOCUMENTS

| | | | | |
|---|---|---|---|---|
| 6,874,170 | B1 * | 4/2005 | Aaron | A41D 13/0512 2/468 |
| 2004/0078877 | A1 | 4/2004 | Harty | |
| 2018/0184732 | A1 * | 7/2018 | Plant | B32B 27/12 |

FOREIGN PATENT DOCUMENTS

| | | | | |
|---|---|---|---|---|
| CA | 2978239 | A1 * | 2/2018 | F41H 1/02 |
| JP | 2006166952 | A | 6/2006 | |
| JP | 2008196084 | A | 8/2008 | |
| WO | WO-2017019217 | A1 * | 2/2017 | A41D 13/0512 |

* cited by examiner

INJURY PROTECTION DEVICE

FIELD OF INVENTION

The present invention relates to individual injury protection means for protecting, for example, from neck injuries, which can be used in team sports, such as football, hockey, basketball, handball, rugby, etc.

BACKGROUND

In recent decades, remarkable technological progress has been achieved in the development of injury protection means. Despite great development efforts, the existing injury protection means do not efficiently prevent impact injuries.

RU 2630144 (IPC: C08J 9/00; C08J 5/18; C08L 67/04; C08L 23/00; B82Y 30/00, as of Jun. 6, 2014, published 28 Jun. 2017 in official patent bulletin No. 19) discloses a protective element absorbing impact energy, which comprises a polymeric material formed by drawing from a thermoplastic composition. The thermoplastic composition comprises a continuous phase which comprises a matrix polymer and in which a micro-inclusion additive and a nano-inclusion additive are dispersed in the form of discrete domains. The material defines a pore network which includes a plurality of nanopores with an average cross-sectional dimension of about 800 nm or less. The matrix polymer includes polyolefin or polyester characterized by a glass transition temperature about 0° C. or more. The micro-inclusion additive in the whole thermoplastic composition has a concentration from about 1 wt % to about 20 wt %, while the nano-inclusion additive in the whole thermoplastic composition has a concentration from about 0.01 wt % to about 15 wt %. The micro-inclusion additive includes polyolefin, while the nano-additive is polymeric. The thermoplastic composition further comprises a phase interface modifier. In the protective element, the polymeric material is characterized by a Charpy impact strength for a notched sample about 10 kilojoules per square meter ($kJ/m^2$) or more, preferably about 20 $kJ/m^2$ or more, more preferably about 35 $kJ/m^2$ or more, and even more preferably from about 45 $kJ/m^2$ to about 100 $kJ/m^2$, when measured at 23° C. according to ASTM D6110-10. The total energy absorbed by the polymeric material is about 2 J or more, preferably about 3 J or more, and more preferably from about 4 J to about 20 J, as determined by a high-speed puncture test carried out in accordance with ASTM D3763-10 at a speed of 12.5 m/s and a temperature of 23° C. The deflection of the polymeric material at a maximum load is about 10 mm or more, preferably about 12.5 mm or more, and more preferably from about 15 mm to about 50 mm, as determined by the high-speed puncture test carried out in accordance with ASTM D3763-10 at the speed of 12.5 m/s and the temperature of 23° C. The maximum load of the polymeric material is about 250 N or more, preferably about 350 N or more, and more preferably from about 400 N to about 1000 N, as determined by the high-speed puncture test carried out in accordance with ASTM D3763-10 at the speed of 12.5 m/s and the temperature of 23° C. The nanopores are characterized by the average cross-sectional dimension from about 10 nm to about 100 nm. The total pore volume in the polymeric material ranges from about 15% to about 80% per $cm^3$. The nanopores is about 20 vol % or more of the total pore volume in the polymeric material. The continuous phase is from about 60 wt % to about 99 wt % of the thermoplastic composition.

The matrix polymer includes polylactic acid. The micro-inclusion additive is represented by propylene homopolymer, propylene/α-olefin copolymer, an ethylene/α-olefin copolymer or a combination thereof. The ratio of a solubility parameter of the matrix polymer to that of the micro-inclusion additive is from about 0.5 to about 1.5, the ratio of a melt flow rate of the matrix polymer to that of the micro-inclusion additive is from about 0.2 to about 8, and/or the ratio of a modulus of elasticity of the matrix polymer to that of the micro-inclusion additive is from about 1 to about 250. The nano-inclusion additive may be represented by functionalized polyolefin. The nano-inclusion additive is reactive. The nano-inclusion additive may be represented by polyepoxide. The nano-inclusion additive is from 0.05 wt % to about 10 wt % of the whole thermoplastic composition.

The phase interface modifier is characterized by a kinematic viscosity from about 0.7 to about 200 centistokes (cSt), as determined at a temperature of 40° C. The phase interface modifier is hydrophobic. The phase interface modifier is silicon, silicone-polymer ether copolymer, aliphatic polyester, aromatic polyester, alkylene glycol, alkanediol, amine oxide, fatty acid ester, or a combination thereof. The phase interface modifier ranges from about 0.1 to about 20 wt % of the composition according to the weight of the continuous phase. The polymeric material generally does not comprise gaseous pore-forming agents. The pore network further includes micropores. The ratio of micropore sides ranges from about 1 to about 30. The pore network is distributed in an advantageously uniform manner throughout the material. The nanopores are distributed by advantageously parallel columns. The micro-sized domains are characterized by an average axial dimension from about 0.5 μm to about 250 μm. The thermoplastic composition is characterized by a density of about 1.2 $g/cm^3$ or less. The protective element is in the form of a fabric. The fabric is a woven or knitted fabric that contains multiple yarns, with at least a part of the yarns including the polymeric material. The protective element is fully made of the polymeric material. The polymeric material is a layer or component of the protective element. The protective element comprises an outer shell layer disposed closely to the polymeric material. The polymeric material is provided between the outer shell layer and an inner shell layer. The shell layer includes strength-enhancing fibers, a metal sheet, a ceramic sheet, or a combination thereof. The protective element comprises a layer including the polymeric material and multiple strength-enhancing fibers. The strength-enhancing fibers are provided over the polymeric material. The protective element is designed to be arranged closely to body parts. The protective element forms only a component of protective equipment. The protective equipment is represented by a bullet-proof body armor or casing, a body armor, clothing or other garment used for restraining riots in correctional facilities, an item of clothing or ammunition used in martial arts, a helmet, a shin guard, an elbow pad, a glove, a ski boot, a snowboard boot, a motorcycle outfit, a skate, athletic shoes, an orthopedic splint or a bandage, or a combination thereof.

The protective element known from RU 2630144 suffers from the following drawback: an insufficiently high level of protection against impact injuries.

RU 71556 (IPC: A63B 71/16, A42B 3/00, as of Dec. 18, 2007; published 20 Mar. 2008 in official patent bulletin No. 8) discloses an injury protection device designed as a shell having multiple cells in the form of holes. The shell is made of an elastically deformable material. The shell has interconnected cavities and is provided with at least one nozzle for filling these cavities with a gas. The injury protection device is made as a helmet or helmet liner configured to protect a head along with a forehead and an occipital part, as well as cervical vertebrae. The helmet or helmet liner is provided with an advantageously removable face shield which has slits at the level of eyes and a mouth and is made in a similar manner as the shell. The helmet or helmet liner is provided with a protective visor. The cells have a square, triangular, hexagonal, or round shape. Protrusions are formed in intersection nodes of shell branches. Each cell has a size which does not exceed a size of a puck and/or a boot toe, and/or an elbow edge when an arm is bent at an elbow joint. The number of the cells per unit area of the shell and/or the sizes of the cells, and/or the thickness of the shell in its different parts are different.

The injury protection device known from RU 71556 suffers from the following drawback: an insufficiently high level of protection against impact injuries.

A collar for adult hockey players has been found by using Yandex search engine (sportmaster.ru/catalog/khokkey/). According to safety rules, it is recommended to wear a neck guard which is shortly called the collar. There are collars in the form of a ring around the neck or with an additional shield for collarbone protection. It is mandatory to use the collar for athletes under 18 years of age, while it is only a recommendation for older athletes. The collars are made of polyurethane foam, something like a sponge. It protects against accidental hooking with a hockey stick and can also save vital arteries from being cut by a skate blade. The player neck and throat guard has an inner layer of KEVLAR and an extended protection area. An inner liner is made as 37.5 Polyester liner. The neck guard protects an athlete from scratches and cuts by using high-strength nylon. The main task of the neck guard is to protect the vital arteries from cuts caused by the skate blade and abrasions, as well as to somewhat reduce the impact energy resulted from the hockey stick or puck because it cannot provide full protection. The use of impact-absorbing foam and plastic inserts does not reliably protect the neck from impacts. Special materials are used, which cannot provide good thermoregulation and quick moisture removal. This player neck guard allows minimizing the risk of injury while playing hockey. It is made of polyester, foam (see http://weidersport.ru/catalog/shitki-hok).

The neck guard described above suffers from the following drawback: an insufficiently high level of protection against impact injuries and insufficient thermoregulation of a human body.

SUMMARY

The technical result provided by the present invention is an increase of a level of protection against impact injuries and an improvement of thermoregulation of a human body.

The above technical result is achieved by an injury protection device comprising a flexible structural element and a guard which are made of a polymeric material capable of absorbing and dissipating impact energy. The flexible structural element preferably has a thickness of at least 4 mm and is made of the polymeric material in the form of a strip configured as a collar. The flexible structural element comprises a central part arranged in the center of the flexible structural element and two side parts arranged symmetrically on either side of the central part and spaced apart from the central part by central holes. The flexible structural element has an upper side above the central part in the area of a human chin. The upper side is made as an arc whose convex part faces the central part. The flexible structural element has a lower side below the central part. The lower side is made as an arc whose convex part faces away from the central part. The central part is preferably made as a figured or geometric shape advantageously with a height of at least 4 mm. The flexible structural element has a back side which is made advantageously smooth. The flexible structural element has a front side which is embossed in the form of protrusions of arbitrary shape and height, advantageously with a height of at least 1 mm, and arranged on the surface in random order. The guard is advantageously flat and made as a figured or geometric shape with a thickness of at least 4 mm, and has an advantageously smooth back side and a front side having recesses.

None of the above technical solutions found in the prior art comprise features coincident with the distinguishing features of the present invention. Therefore, the present invention meets the patentability requirement of inventive step.

The presence of the essential distinguishing features allows the present invention to be considered novel.

The possibility of industrial implementation of the present invention allows one to consider it meeting the patentability requirement of industrial applicability.

BRIEF DESCRIPTION OF THE DRAWINGS

The essence of the present invention is explained by the following drawings.

DETAILED DESCRIPTION OF THE PREFERRED EMBODIMENT

Figure 1:
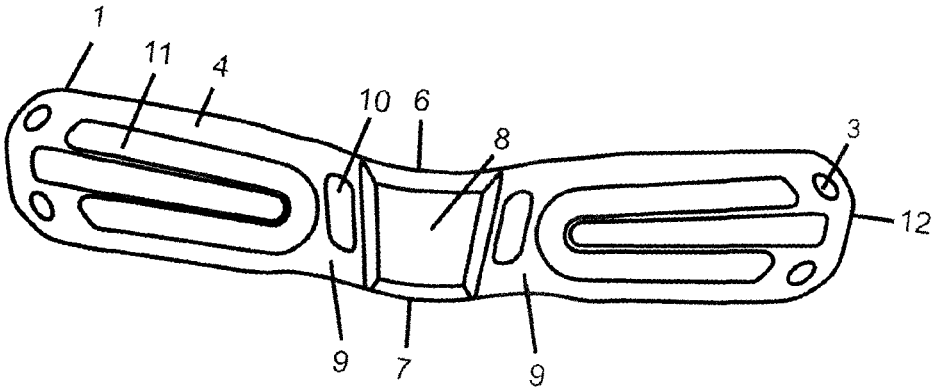
FIG. 1 shows a top view of a flexible structural element.
Figure 2:
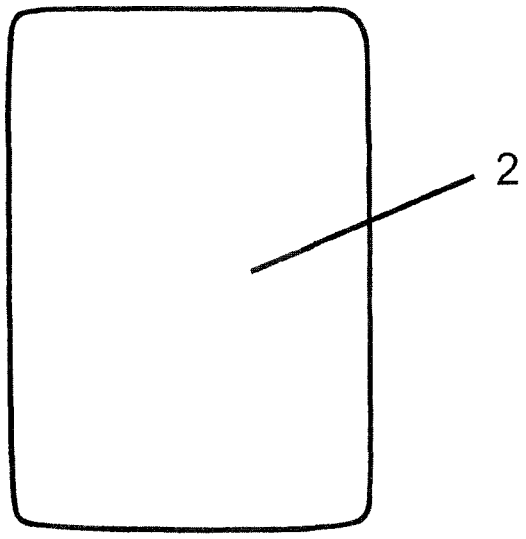
FIG. 2 shows a frontal view of a guard.
Figure 3:
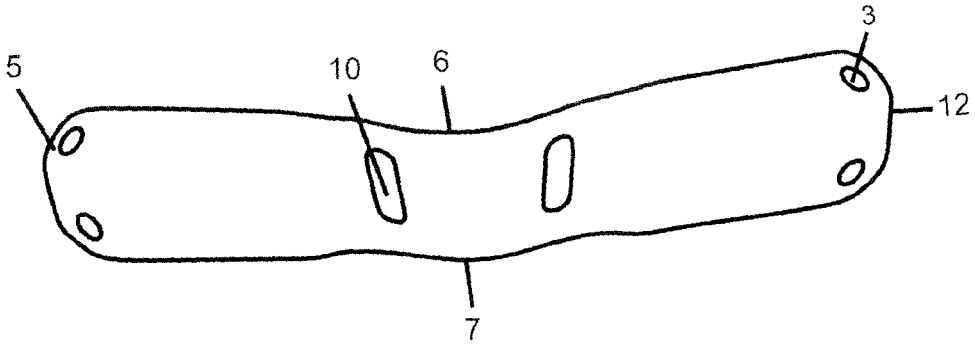
FIG. 3 shows a back view of the flexible structural element.

An injury protection device comprises a flexible structural element 1 and a guard 2 for backside neck protection. The flexible structural element 1 preferably has a thickness of at least 4 mm and is made of a polymeric material capable of absorbing and dissipating impact energy. The flexible structure element 1 is in the form of a strip configured as a collar. If the thickness of the flexible structural member 1 is less than 4 mm, a high level of protection against impact injuries and thermoregulation of a human body are not achieved.

The flexible structural element 1 comprises a central part 8 and two side parts 9. The central part 8 is arranged in the center of the flexible structural element 1, and the side parts 9 are arranged symmetrically relative to the central part 8 and spaced apart therefrom by central holes 10.

The flexible structural element 1 has an upper side 6 above the central part 8 in the area of a human chin. The upper side 6 is made as an arc whose convex part faces the central part 8.

The flexible structural element 1 has a lower side 7 below the central part 8. The lower side 7 is made as an arc whose convex part faces away from the central part 8.

The central part 8 is preferably made as a figured or geometric shape advantageously with a height of at least 4 mm.

The flexible structural element 1 has a back side 5 which is made advantageously smooth. If the thickness of the central part 8 is less than 4 mm, the high level of protection against impact injuries and the thermoregulation of the human body are not achieved.

The flexible structural element 1 has a front side 4 which is embossed in the form of protrusions 11 of arbitrary shape. The protrusions 11 advantageously have a height of at least 1 mm and are arranged on the surface in random order, thereby stiffening the flexible structural element 1.

If the height of the protrusions 11 is less than 1 mm, the high level of protection against impact injuries and the thermoregulation of the human body are not achieved. There are at least two side holes 3 between the protrusions 11 and a lateral side 12 of each of the side parts 9 of the flexible structural element 1. The central part 8 preferably made as a figured or geometric shape and having a thickness of at least 4 mm, the protrusions 11 having a height of at least 1 mm and forming an air gap between the surface of the back side 5 of the flexible structural element 1 and a casing wall, and the central and side holes 10, 13 allow improving the thermoregulation and a condition of heat and vapor exchange in temperature-sensitive areas of the human body.

Both of the flexible structural element 1 made of the polymeric material capable of absorbing and dissipating the impact energy and comprising the protrusions 11 of arbitrary shape and height, and the guard 2 for backside neck protection reduce severe injuries caused by impacts and/or collisions in the front of and behind the neck.

The flexible structural element 1 can be applied to a human of different weight and size.

The guard 2 for backside neck protection is advantageously flat and made as a figured or geometric shape. The guard 2 has a thickness of at least 4 mm. The guard 2 has an advantageously smooth back side and a front side having recesses. The guard 2 is made of a polymeric material capable of absorbing and dissipating the impact energy. The injury protection device is used in a suitably sized casing comprising a fixing means.

The injury protection device operates as follows.

The flexible structural element 1 and the guard 2 are first arranged in the suitably sized casing comprising the fixing means. The casing has an inner layer which is, in the front, preferably made of KEVLAR material characterized by a high-tensile strength and protecting from cutting items, for example, a skate blade. Then, the casing is put around a human neck prior to holding a sports match, hazardous work associated with the risk of injury due to an impact or push, as well as during training and competitive sports events, and fixed on human neck using the fixing means. Due to its design and elastic properties, the injury protection device fits snugly around the protected human neck. In case of an impact or push occurred in the area of the human neck, elastic strains of the flexible structural element 1 and the guard 2 take place. Severe injuries caused by impacts and/or collisions in the front of and behind the neck are reduced because the impact energy is absorbed and dissipated by using the following:

the flexible structural element 1 which is made of the polymeric material capable of absorbing and dissipating the impact energy and comprises the central part 8 preferably made as a figured or geometric shape advantageously with a height of at least 4 mm, the flexible structural element 1 having a front side embossed in the form of the protrusions 11 of arbitrary shape and height, advantageously with a height of at least 1 mm, and the flexible structural element 1 comprising the central and side holes 10, 3; and the guard 2 which is advantageously smooth and made as a figured or geometric shape, the guard 2 having a thickness of at least 4 mm with the smooth back side and the front side having recesses.

The central part 8 preferably made as a figured or geometric shape advantageously with a height of at least 4 mm, the protrusions 11, and the guard 2 for backside neck protection, which is advantageously smooth and made as a figured or geometric shape with a thickness of at least 4 mm, form the air gap between each other and the casing wall. The air gap provides, in concert with the central and side holes 10, 3, an input and output for an air flow, thereby protecting the human body from general heat stress in case of excessive sweating and improving the human body thermoregulation, and preventing their adverse effect on athlete performance.

By using the injury protection device, it is possible to increase the level of protection against impact injuries and improve the thermoregulation of the human body.

What is claimed is:

1. An injury protection device, comprising: a flexible structural element and a guard which are made of a polymeric material capable of absorbing and dissipating impact energy, wherein the flexible structural element preferably has a thickness of at least 4 mm and is made of the polymeric material in a form of a strip configured as a collar, the flexible structural element comprising a central part arranged in a center of the flexible structural element and two side parts arranged symmetrically on either side of the central part and spaced apart from the central part by central holes, wherein the flexible structural element has an upper side above the central part in an area of a human chin, the upper side being made as an arc whose convex part faces the central part, wherein the flexible structural element has a lower side below the central part, the lower side being made as an arc whose convex part faces away from the central part, the central part being preferably made as a figured or geometric shape advantageously with a height of at least 4 mm, wherein the flexible structural element has a back side made advantageously smooth and a front side embossed in a form of protrusions of arbitrary shape and height, preferably with a height of at least 1 mm, the protrusions being arranged on the surface in random order, and wherein the guard is advantageously flat and made as a figured or geometric shape with a thickness of at least 4 mm, the guard having a advantageously smooth back side and a front side having at least two recesses.

* * * * *